US010992015B2

(12) United States Patent
Uemichi

(10) Patent No.: US 10,992,015 B2
(45) Date of Patent: Apr. 27, 2021

(54) COUPLING COMPRISING A GUIDE MEMBER EMBEDDED WITHIN A BLIND VIA OF A POST-WALL WAVEGUIDE AND EXTENDING INTO A HOLLOW TUBE WAVEGUIDE

(71) Applicant: Fujikura Ltd., Tokyo (JP)

(72) Inventor: Yusuke Uemichi, Sakura (JP)

(73) Assignee: FUJIKURA LTD., Tokyo (JP)

( * ) Notice: Subject to any disclaimer, the term of this patent is extended or adjusted under 35 U.S.C. 154(b) by 13 days.

(21) Appl. No.: 16/328,081

(22) PCT Filed: Aug. 18, 2017

(86) PCT No.: PCT/JP2017/029648
§ 371 (c)(1),
(2) Date: Feb. 25, 2019

(87) PCT Pub. No.: WO2018/038018
PCT Pub. Date: Mar. 1, 2018

(65) Prior Publication Data

US 2019/0181528 A1 Jun. 13, 2019

(30) Foreign Application Priority Data

Aug. 26, 2016 (JP) ..... JP2016-165770

(51) Int. Cl.
*H01P 3/12* (2006.01)
*H01P 5/08* (2006.01)
(Continued)

(52) U.S. Cl.
CPC ..... *H01P 3/121* (2013.01); *H01P 5/024* (2013.01); *H01P 5/082* (2013.01); *H01P 5/087* (2013.01); *H01P 5/103* (2013.01)

(58) Field of Classification Search
CPC ..... H01P 3/121; H01P 5/087; H01P 5/082; H01P 5/024
(Continued)

(56) References Cited

U.S. PATENT DOCUMENTS 3,146,410 A 8/1964 Butler
5,982,256 A * 11/1999 Uchinnura et al. ..... H01P 1/047 333/239
(Continued)

FOREIGN PATENT DOCUMENTS

CN 102129102 A 7/2011
CN 202275909 U 6/2012
(Continued)

OTHER PUBLICATIONS

Notification of Reason for Refusal dated Apr. 25, 2017, issued in counterpart Japanese Patent Application No. 2016-165770 (3 pages).
(Continued)

*Primary Examiner* — Benny T Lee
(74) *Attorney, Agent, or Firm* — Westerman, Hattori, Daniels & Adrian, LLP

(57) ABSTRACT

A transmission line includes a post-wall waveguide which includes a dielectric substrate on which a pair of post-walls is formed and a first conductor layer and a second conductor layer opposed to each other with the dielectric substrate interposed therebetween, and in which a region surrounded by the pair of post-walls, the first conductor layer, and the second conductor layer is a waveguide region, a waveguide tube having a hollow rectangular shape, being connected with the first conductor layer to cover an opening portion formed in a side wall, and in which an inside communicates with the waveguide region through an opening formed in the first conductor layer, a blind via formed in the dielectric substrate such that one end is disposed inside the opening,
(Continued)

and a pole member including a post member connected to the one end of the blind via and a support member supporting the post member.

14 Claims, 12 Drawing Sheets

(51) Int. Cl.
*H01P 5/02* (2006.01)
*H01P 5/103* (2006.01)

(58) Field of Classification Search
USPC ..... 333/24 R, 248
See application file for complete search history.

(56) References Cited

U.S. PATENT DOCUMENTS

| | | | | |
|---|---|---|---|---|
| 8,598,961 | B2 * | 12/2013 | Hasselblad et al. | .... H01P 1/025 333/21 R |
| 2006/0274992 | A1 | 12/2006 | Shimura et al. | |
| 2011/0037531 | A1 | 2/2011 | Hasselblad et al. | |
| 2011/0267152 | A1 | 11/2011 | Lee | |

FOREIGN PATENT DOCUMENTS

| | | | |
|---|---|---|---|
| CN | 103650235 | A | 3/2014 |
| CN | 105609909 | A | 5/2016 |
| GB | 2497982 | A | 7/2013 |
| JP | 4-358405 | A | 12/1992 |
| JP | 3464104 | B2 | 11/2003 |
| JP | 4395103 | B2 | 1/2010 |
| JP | 4677944 | B2 | 4/2011 |
| JP | 2012-195757 | A | 10/2012 |
| JP | 2013-126099 | A | 6/2013 |
| JP | 2015-80100 | A | 4/2015 |
| JP | 2015-80101 | A | 4/2015 |
| JP | 2015-226109 | A | 12/2015 |
| JP | 5885775 | B2 | 3/2016 |
| JP | 2016-149755 | A | 8/2016 |

OTHER PUBLICATIONS

Decision to Grant a Patent dated Jul. 11, 2017, issued in counterpart Japanese Patent Application No. 2016-165770 (3 pages).

International Search Report dated Oct. 31, 2017, issued in counterpart application No. PCT/JP2017/029648, w/English translation (5 pages).

Luo, Wuqiong et al., "Bandwidth Enhancement of Coaxial Line to Post-wall Waveguide Transition Using Short-ended Straight Post in 60-GHz Band", Asia-Pacific Microwave Conference, 2008, pp. 1-4; Cited in CN Office Action dated Aug. 24, 2020.

Yong, Gu et al.,"Design of a Novel Waveguide-SIW Converter", China Academic Journal Electronic Publishing House, Aug. 2019, pp. 260-262; Cited in CN Office Action dated Aug. 24, 2020.

Office Action dated Aug. 24, 2020, issued in counterpart CN Application No. 2017800507111, with English translation (3 pages).

* cited by examiner

COUPLING COMPRISING A GUIDE MEMBER EMBEDDED WITHIN A BLIND VIA OF A POST-WALL WAVEGUIDE AND EXTENDING INTO A HOLLOW TUBE WAVEGUIDE

CROSS REFERENCE TO RELATED APPLICATION

The present application claims priority based on Japanese patent application 2016-165770, filed on Aug. 26, 2016 and the contents of which are incorporated herein by reference.

The present invention relates to a transmission line.

TECHNICAL FIELD

Background Art

Conventionally, a waveguide tube is used as a transmission line for transmitting a high-frequency signal in the microwave band (0.3 to 30 [GHz]) to the millimeter wave band (30 to 300 [GHz]). In recent years, a post-wall waveguide (PWW) has also been used as a transmission line for transmitting such a high-frequency signal. The post-wall waveguide is a square-shape waveguide formed by a pair of conductor layers formed on both surfaces of a dielectric substrate and a pair of post-walls formed by arranging a plurality of conductor posts to penetrate the dielectric substrate in two rows.

The above-mentioned waveguide tube and post-wall waveguide may be used singly; however, they may be used in combination. For example, in a communication module, a transmission line in which a waveguide tube and a post-wall waveguide are combined is used as a transmission line between a transmission-reception circuit and an antenna. In such a communication module, for example, the high-frequency signal output from the transmission-reception circuit is transmitted to the waveguide tube after being transmitted by the post-wall waveguide, and being transmitted from the antenna after being transmitted by the waveguide tube.

The following Patent Documents 1 to 7 disclose a conventional transmission line in which transmission lines of different types are combined. For example, the following Patent Documents 1 to 5 disclose a conventional transmission line in which a waveguide tube and a post-wall waveguide are combined. The following Patent Document 6 discloses a conventional transmission line in which a waveguide tube and a print circuit board are combined. The following Patent Document 7 discloses a conventional transmission line in which a microstrip line and a post-wall waveguide are combined.

PRIOR ART DOCUMENTS

Patent Documents

[Patent Document 1] Japanese Patent No. 5885775 (published Mar. 15, 2016)

[Patent Document 2] Japanese Unexamined Patent Application, First Publication No. 2015-80100 (published Apr. 23, 2015)

[Patent Document] Japanese Unexamined Patent Application, First Publication No. 2015-226109 (published Dec. 14, 2015)

[Patent Document 4] Japanese Unexamined Patent Application, First. Publication No. 2012-195757 (published Oct. 11, 2012)

[Patent Document 5] Japanese Patent No. 4395103 (published Jan. 6, 2010)

[Patent Document 6] Japanese Patent No. 4677944 (published Apr. 27, 2011)

[Patent Document 7] Japanese Patent No. 3464104 (published Nov. 5, 2003)

SUMMARY OF THE INVENTION

Problems to be Solved by the Invention

In recent years, communication using the E band (70 to 90 GHz-band) attracts attention. In such communication arrangements, in a common port (antenna connection terminal) of, for example, a diplexer (a three-port filter element that is connected to an antenna and separates two frequency ranges), a broadband high-frequency signal of 71 to 86 band are input and output. Therefore, the transmission line for transmitting such a high frequency signal is required to have low reflection loss (for example, the reflection loss is −15 [dB] or less) over a wide hand of 71 to 86 GHz-band.

Here, for example, in a transmission line (a transmission line in which a waveguide tube and a post-wall waveguide are combined) disclosed in Patent Document 1 described above, the band in which the reflection loss is low is, for example, 57 to 67 GHz-band. As described above, in the transmission line disclosed in Patent Document 1 described above, the band where the reflection loss is low is approximately 10 [GHz], and when the high-frequency signal over the wide band range of the above-mentioned 71 to 86 GHz-band is transmitted, there is a problem in that the band width is insufficient.

In the transmission line disclosed in Patent Document 1 described above, a waveguide tube is vertically attached to a dielectric substrate constituting a post-wall waveguide, and between the post-wall waveguide and the waveguide tube, the transmission directions of the high-frequency signals are orthogonal to each other. Therefore, in the transmission line disclosed in Patent Document 1 described above, for example, when an external force is applied to the waveguide tube, moment of force is generated and large force acts on the installation position of the waveguide tube with respect to the post-wall waveguide. When the dielectric substrate forming the post-wall waveguide is formed of a brittle material such as glass, there is an issue in terms of strength.

The present invention has been made in view of the above circumstances, and provides a strong transmission line having low reflection loss over a wide band.

Means for Solving the Problems

A transmission line according to one aspect of the present invention includes a post-wall waveguide which includes a dielectric substrate on which a pair of post-walls is formed and a first conductor layer and a second conductor layer opposed to each other with the dielectric substrate interposed therebetween, and in which a region surrounded by the pair of post-walls, the first conductor layer, and the second conductor layer is the waveguide region, a waveguide tube having a hollow rectangular shape, being connected with the first conductor layer so as to cover an opening portion formed in a side wall, and in which an inside of the waveguide tube communicates with the waveguide region through an opening formed in the first conductor layer, a blind via formed in the dielectric substrate such that one end is disposed inside the opening, and a pole member including a post member connected to the one end of the blind via and a support member supporting the post member, the post member being disposed in the waveguide such that the pillar member is coaxial with the blind via.

In the aspect described above, the blind via and the post member are connected by a conductive connection member.

In the aspect described above, at the one end of the blind via, a first land having a larger diameter than the blind via and on which the conductive connecting member is disposed is formed, and at one end disposed on the blind via side of the post member, a second land having a larger diameter than the post member and on which the conductive connecting member is disposed is formed.

In the aspect described above, the conductive connecting member is a spherical member having a solder layer formed on a surface the spherical member.

In the aspect described above, the blind via is formed along an inner wall of a hole formed from the opening side to a part of the dielectric substrate and has a cylindrical shape having a closed longitudinal end.

In the aspect described above, the transmission line comprises a plurality of bumps supporting the support member at a plurality of positions on the first conductor layer.

In the aspect described above, the support member has a rectangular parallelepiped shape in which a length in a direction perpendicular to an axial direction of the waveguide is shorter than a length in the axial direction of the waveguide.

In the aspect described above, an axial direction of the waveguide tube is the same direction as a direction in which the waveguide region of the post-wall waveguide extends.

In the aspect described above, the pair of post walls each include a post protrusion portion protruding toward the waveguide region.

In the aspect described above, each of the post walls comprises a plurality of conductor posts arranged at intervals, and the post protrusions are formed by a portion of conductor posts of the plurality of conductor posts displaced toward the waveguide region.

In the aspect described above, each of the post walls comprises a plurality of conductor posts arranged at intervals, and the post protrusions are formed by other conductor posts adjacent to the plurality of conductor posts.

In the aspect described above, the waveguide region is formed to extend in a predetermined direction, and the post protrusion portions on the pair of post walls are arranged at equivalent positions, in the predetermined direction.

In the aspect described above, a distance from an end of the waveguide region in the predetermined direction to the post protrusion portion is set based on a wavelength in a tube of a signal transmitted through the transmission line.

Effects of the Invention

According to the above aspects of the present invention, the inside of the waveguide tube and the waveguide region of the post-wall waveguide communicate with each other through an opening formed in the first conductor layer of the post-wall waveguide. In the dielectric substrate of the post-wall waveguide, a blind via is formed such that one end is located inside of the opening, and inside a tube of the waveguide tube, a pole member arranged such that a conductor post and the blind via are coaxial. As a result, it is possible to obtain a strong transmission line having low reflection loss over a wide band.

DETAILED DESCRIPTION OF THE EMBODIMENTS OF THE INVENTION

Figure 1:
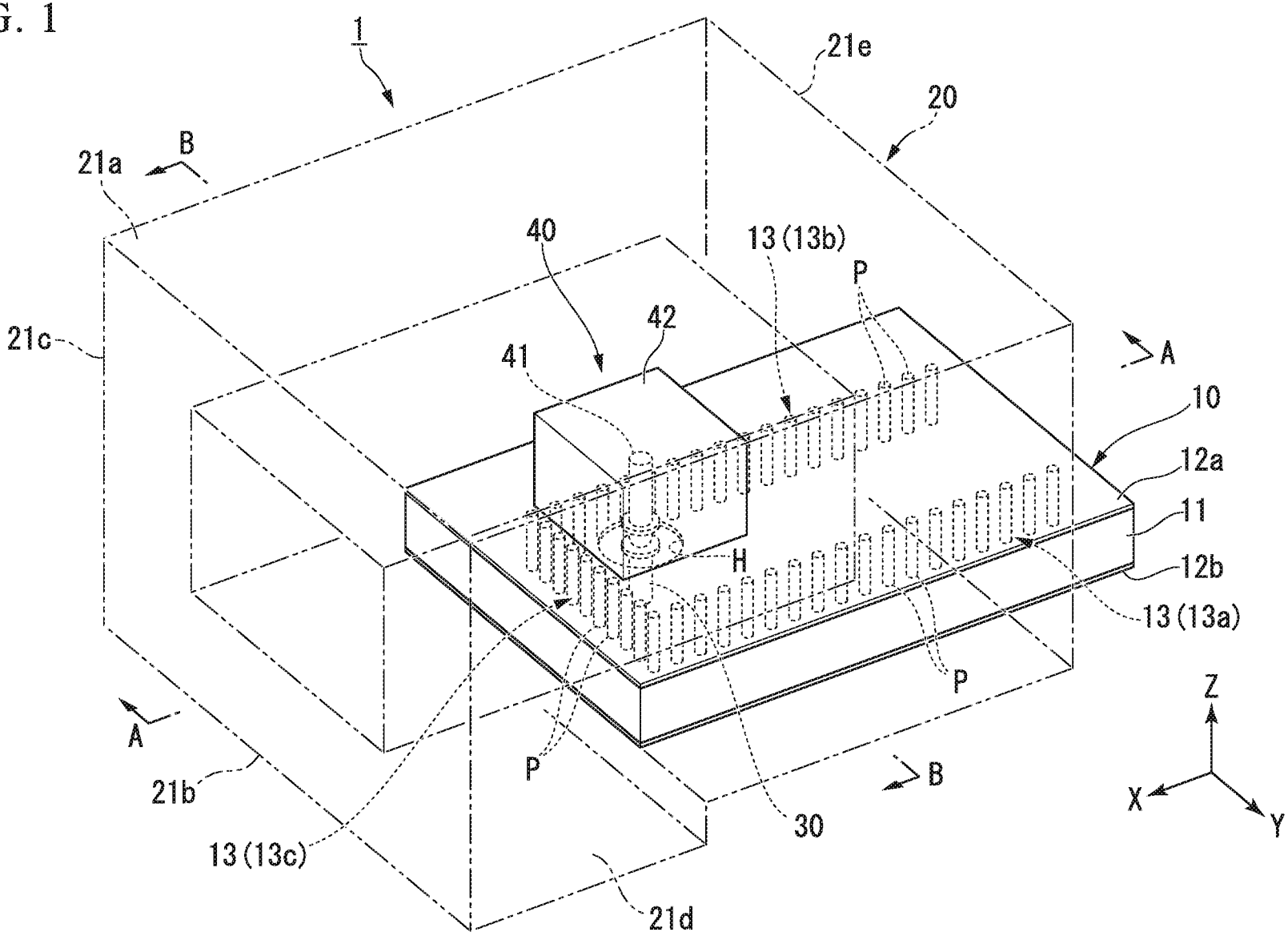
FIG. 1 is a perspective view showing a configuration of a main portion of a transmission line according to the first embodiment of the present invention.

Hereinafter, a transmission line according to the first embodiment of the present invention will be described in detail with reference to the drawings wherein the same members throughout the drawings are denoted by the same reference numerals and descriptions thereof may be omitted in certain circumstances. In the following descriptions, for ease of understanding, the positional relationship of each member will be described while referring to the XYZ orthogonal coordinate system (the position of the origin is appropriately changed) set in the drawings as necessary. Throughout the drawings, respective arrows show positive direction, such as +X, in the XYZ orthogonal coordinate system. In addition, in the drawings referred to below, for ease of understanding, dimensions of each member are appropriately changed and shown as necessary.

Figure 2:
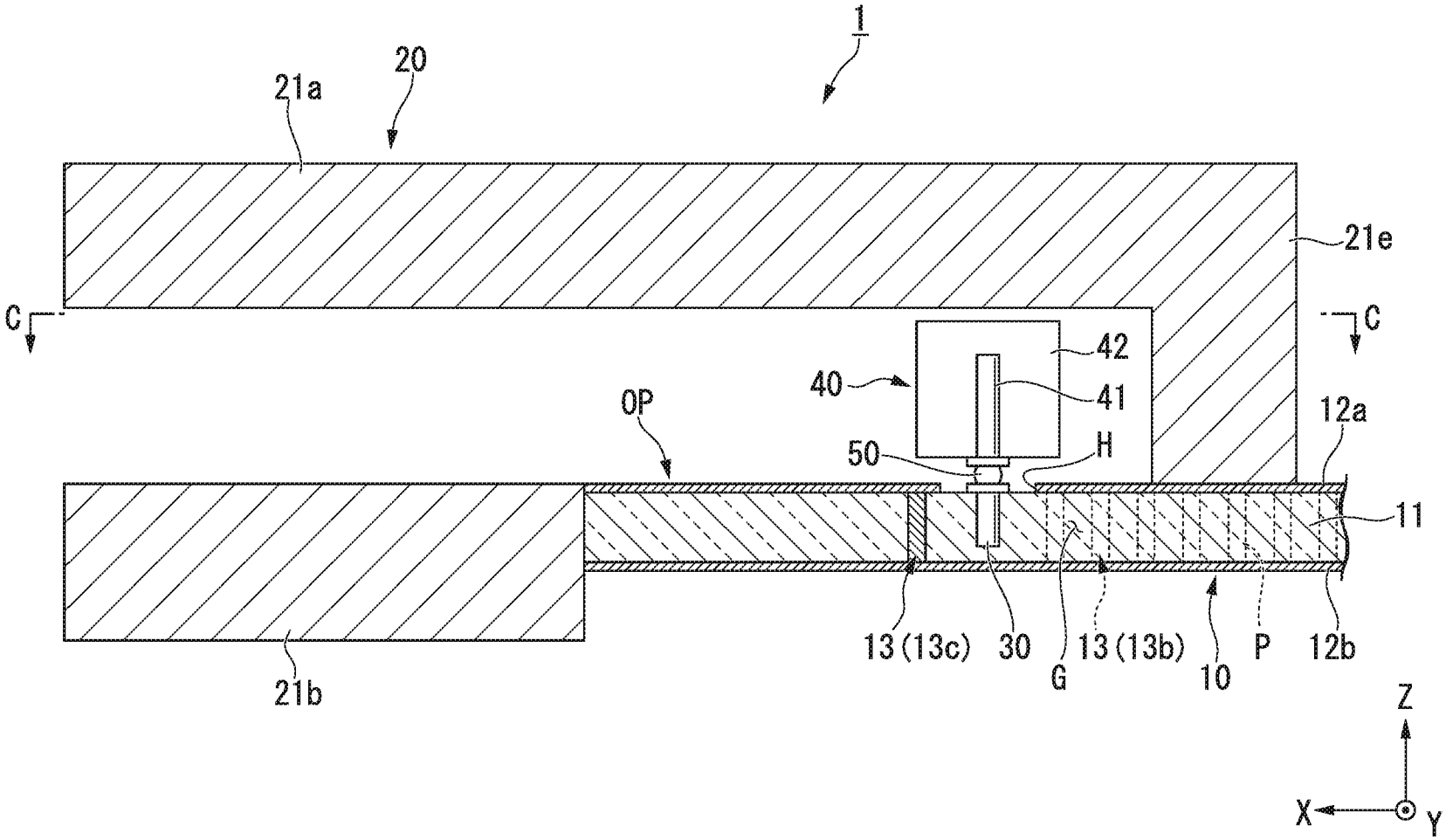
FIG. 2 is a cross-sectional view taken along a line A-A in FIG. 1.
Figure 3:
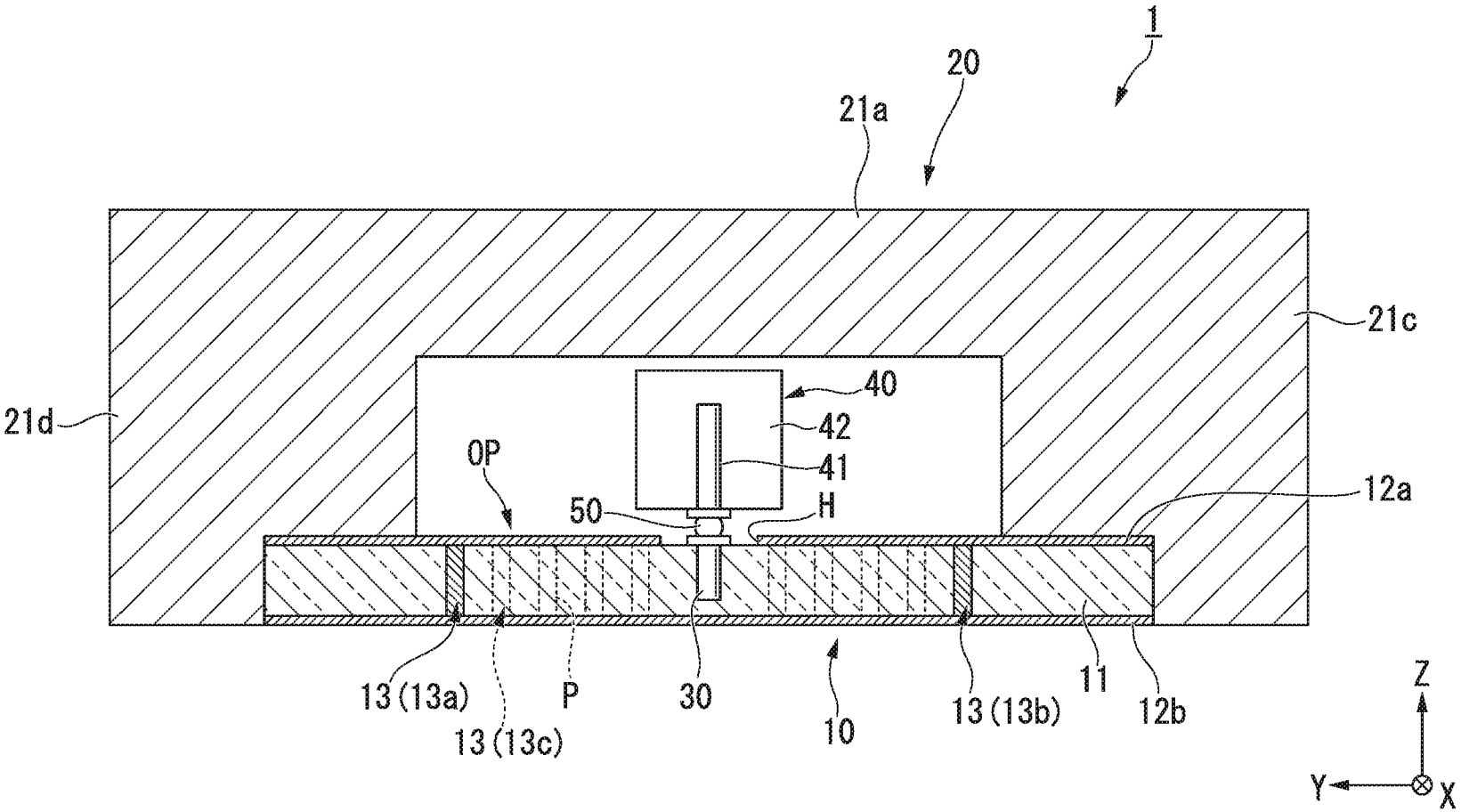
FIG. 3 is a cross-sectional view taken along a line B-B in FIG. 1.

FIG. 1 is a perspective view showing a configuration of a main portion of a transmission line according to the first embodiment of the present invention. FIG. 2 is a sectional view taken along a line A-A in FIG. 1. FIG. 3 is a cross-sectional view taken along a line B-B in FIG. 1. In the XYZ orthogonal coordinate system shown in FIGS. 1 to 3, the X axis is set in the longitudinal direction (front-rear direction) of the transmission line 1, the Y axis is set in the width direction (horizontal direction) of the transmission line 1, and the Z axis is set in the height direction (vertical direction) of the transmission line 1.

As shown in FIGS. 1 to 3, the transmission line 1 includes a post-wall waveguide 10, a waveguide tube 20, a blind via 30, and a pole member 40, and transmits a high-frequency signal along a longitudinal direction (X direction) of the transmission line 1. In the present embodiment, for ease of understanding, the case where the transmission line 1 transmits a high-frequency signal in the direction from the −X side to the +X side will be described as an example. However, it is also possible for the transmission line 1 to transmit a high-frequency signal in the direction from the +X side to the −X side.

The high-frequency signal transmitted through the transmission line 1 is, for example, a high-frequency signal in the E band (70 to 90 GHz-band).

The post-wall waveguide 10 includes a dielectric substrate 11, a first conductor layer 12*a*, a second conductor layer 12*b*, and a post-wall 13, and an area surrounded by the first conductor layer 12*a*, the second conductor layer 12*b*, and a post-wall 13 is referred to a waveguide region G (FIG. 2). The dielectric substrate 11 is a flat plate-like substrate formed of a dielectric such as glass, a resin, ceramics, or a composite thereof. The dielectric substrate 11 is arranged such that the thickness direction thereof is parallel to the Z axis. The first conductor layer 12*a* and the second conductor layer 12*b* are thin film layers respectively formed on the top and bottom surfaces of the dielectric substrate 11 by conductors such as a metal of copper or aluminum, or an alloy thereof, and the first conductor layer 12*a* and the second conductor layer 12*b* are arranged to face each other with the body substrate 11 interposed therebetween. The first conductor layer 12*a* and the second conductor layer 12*b* can be connected to an external portion so as to have a ground potential. The first conductor layer 12*a* is arranged on the +Z side and the second conductor layer 12*b* is arranged on the −Z side.

The post-wall 13 is a wall member formed by arranging a plurality of conductor posts P penetrating the dielectric substrate 11 and connecting between the first conductor layer 12*a* and the second conductor layer 12*b*. Here, the conductor post P is formed by metal plating of copper or the like in a hole portion (through-hole) penetrating the dielectric substrate 11 in the thickness direction (direction along the Z axis), for example. The post-wall waveguide 10 can also be fabricated by processing a double-sided copper-clad laminate plate such as a printed circuit board (PCB).

Figure 4:
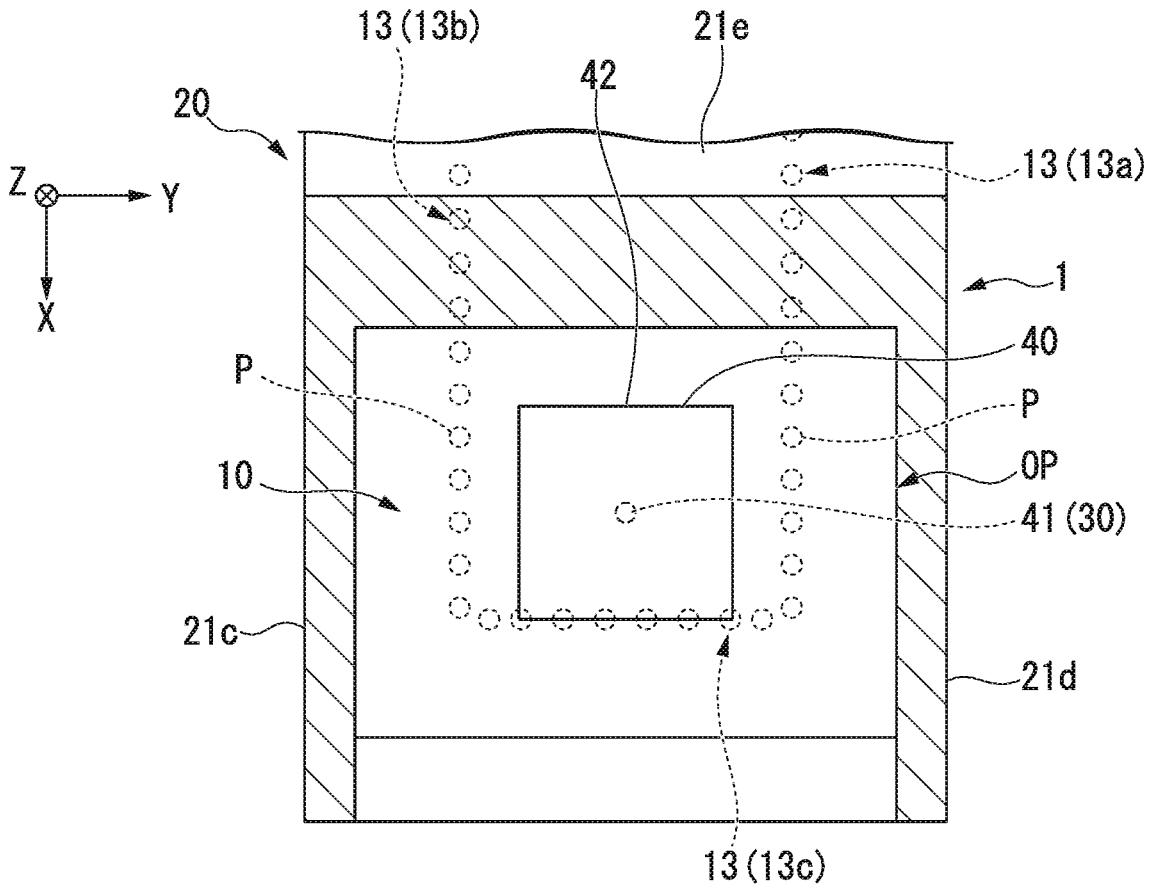
FIG. 4 is a cross-sectional view taken along a line C-C in FIG. 2.

FIG. 4 is a cross-sectional view taken along a line C-C in FIG. 2. As shown in FIG. 4, the post-wall 13 has a pair of first post-walls 13*a* and 13*b* extending parallel to the longitudinal direction (X direction) of the post-wall waveguide 10 and a second post-wall 13*c* extending in the width direction (Y direction) of the post-wall waveguide 10 (short wall). The pair of first post-walls 13*a* and 13*b* are formed by arranging a plurality of conductor posts P in two rows along the longitudinal direction with a predetermined distance in the width direction. That is, the first post-wall 13*a* is formed by a plurality of conductor posts P aligned in the X direction, and the first post-wall 13*b* is formed of a plurality of conductor posts arranged in the X direction at positions different in the Y direction from the first post-wall 13*a*. The second post-wall 13*c* is formed by arranging a plurality of conductor posts P in a row between the +X side end portions of the pair of first post-walls 13*a* and 13*b*.

As described above, in the post-wall waveguide 10, a region surrounded by the first conductor layer 12*a* and the second conductor layer 12*b* and the post-wall 13 is the waveguide region G (FIG. 2). Therefore, the distance between the plurality of conductor posts P constituting the post-wall 13 is set to a distance at which the high-frequency signal propagating in the waveguide region G does not leak to the outside of the post-wall waveguide 10. For example, the distance between the adjacent conductor posts P which is a distance between centers (distance between adjacent conductor posts P in the first post-wall 13*a*, distance between adjacent conductor posts P in the first post-wall 13*b*, and distance between adjacent conductor posts P in the second post-wall 13*c*) is desirable to be set equal to or less than twice the diameter of the conductor post P. Further, the waveguide region G extends in the X direction.

Here, in the first conductor layer 12*a* constituting a part of the post-wall waveguide 10, for example, an opening H (FIGS. 1-3) having a circular shape in a plan view is formed. The shape of the opening H in a plan view may be a shape other than a circular shape (for example, a rectangular shape, a polygonal shape). This opening H is formed at a position separated by a predetermined distance from the second post-wall 13*c* to the −X side in the Y direction of the pair of first post-walls 13*a* and 13*b*. It is desirable that the opening H is formed at a position where the distances (distance in the Y direction) between the opening H and each of the pair of first post-walls 13*a* and 13*b* in the width direction are equal.

As shown by FIG. 1, for example, the waveguide tube 20 includes a pair of upper and lower wide walls (side walls) 21*a* and 21*b*, a pair of left and right narrow walls (side walls) 21*e* and 21*d*, and a narrow wall 21*e* at one end portion (the end on the −X side), and is a hollow rectangular member extending in the X direction. In the waveguide tube 20, a wide wall 21*b* is cut out at one end thereof, and an opening OP (see FIGS. 2 and 3) is formed in the wide wall 21*b*. For example, the wide wall 21*b* is cut out with a width approximately equal to the width of the post-wall waveguide 10 in the central portion in the width direction, and in the longitudinal direction, the opening H and the pole member 40 formed in the first conductor layer 12*a* is formed at least within the tube and is vertically cut out such that at least the inside of the tube of the waveguide tube 20 is exposed to the outside.

To the waveguide tube 20, the first conductor layer 12*a* of the post-wall waveguide 10 is connected such that the opening OP formed in the wide wall 21*b* is covered and such that the axial direction of the waveguide tube 20 and the extending direction of the waveguide region G of the post-wall waveguide 10 are in the same direction. Thereby, the waveguide tube 20 extends in the same direction (X direction) to which the waveguide region G of the post-wall waveguide 10 extends and is connected to the waveguide region G of the post-wall waveguide 10 via the opening H formed in the first conductor layer 12*a*. The axial direction of the waveguide tube 20 is a direction parallel to the longitudinal direction of the waveguide tube 20, and the "sidewall" in the present invention refers to a wall portion along the longitudinal direction of the waveguide tube 20.

In particular, as shown in FIG. 2, the post-wall waveguide 10 is attached to the waveguide tube 20 such that an end portion (an end portion close to the second post-wall 13*c*) abuts the wide wall 21*b* and the first conductor layer 12*a* is flush with the inner wall of the wide wall 21*b*. As shown in FIGS. 2 and 3, the first conductor layer 12*a* of the post-wall waveguide 10 is soldered to the narrow walls 21*c*, 21*d*, and 21*e* such that three sides of the opening H are surrounded by the pair of right and left narrow walls 21*c* and 21*d* of the waveguide tube 20 (as shown by FIG. 3) and the narrow wall 21*e* at one end portion (as shown by FIG. 2).

As shown in FIG. 3, the width of the inside of the tube of the waveguide tube 20 is set to be slightly wider than the distance between the pair of first post-walls 13*a* and 13*b*, and the height of an inner surface of the waveguide tube 20 facing downward is set to be higher than a height of the pole member (precisely, a height including the conductive connection member 50) of a pole member 40 which will be described later, as shown in FIGS. 2 and 3. That is, a gap is formed between the inner surface of the waveguide tube 20, which faces downward, and the upper end of the pole member 40. Further, as described above, since the narrow wall 21*e* is soldered to the first conductor layer 12*a*, the inside of the waveguide tube 20 is formed so as to extend in the +X direction from the narrow wall 21*e*. The width and the height of the inside of the waveguide tube 20 are appropriately set according to the desired characteristics of the transmission line 1.

Figure 5:
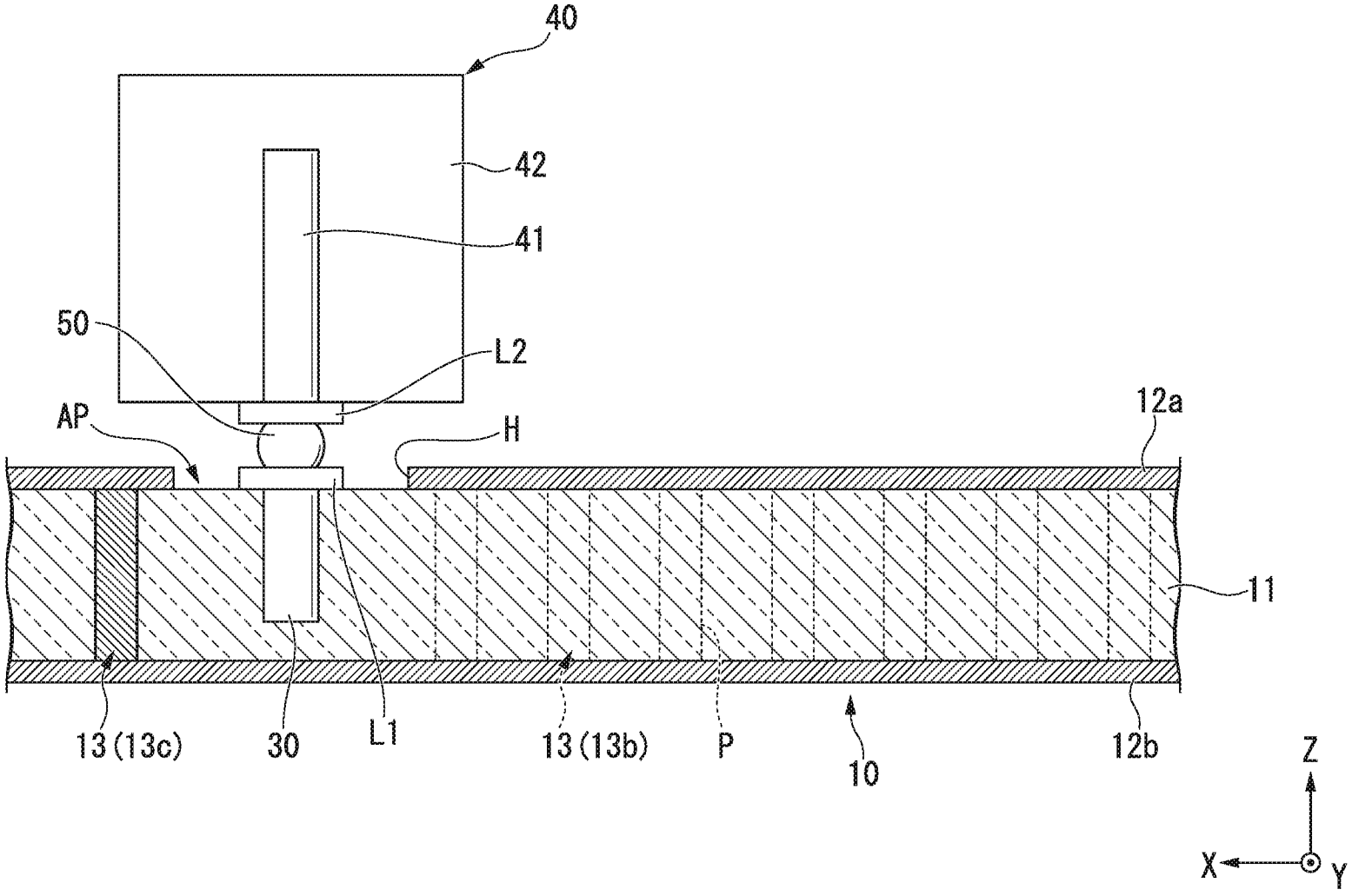
FIG. 5 is an enlarged cross-sectional view of a blind via and a pole member in FIG. 2.

The blind via 30 is a via extending vertically and formed such that the first end (one end) is disposed inside (inward in the radial direction) of the opening H of the first conductor layer 12*a* and the second end is disposed inside the dielectric substrate 11. Although the blind via 30 is desirably formed such that the first end is disposed at a center portion of the opening H, the first end may be slightly shifted from the center portion. The length of the blind via 30 is strictly set to a predetermined length. FIG. 5 is an enlarged sectional view of a blind via and a pole member according to the first embodiment of the present invention. FIG. 5 is an enlarged view of a portion of FIG. 2.

As shown in FIG. 5, a land L1 (first land) having a diameter larger than that of the blind via 30 is formed at the first end of the blind via 30. A conductive connecting member 50 used for connecting the pole member 40 is disposed on the upper portion of the land L1. The land L1 is provided to increase the contact area with the conductive connecting member 50 to increase the connection strength with the pole member 40. The blind via 30 and the land L1 described above are formed by, for example, metal plating of copper or the like on a portion of the dielectric substrate 11 similar to the conductor post P formed in the post wall waveguide 10. Between the land L1 and the first conductor layer 12*a*, an anti-pad AP having a circular ring shape is formed.

Figure 6:
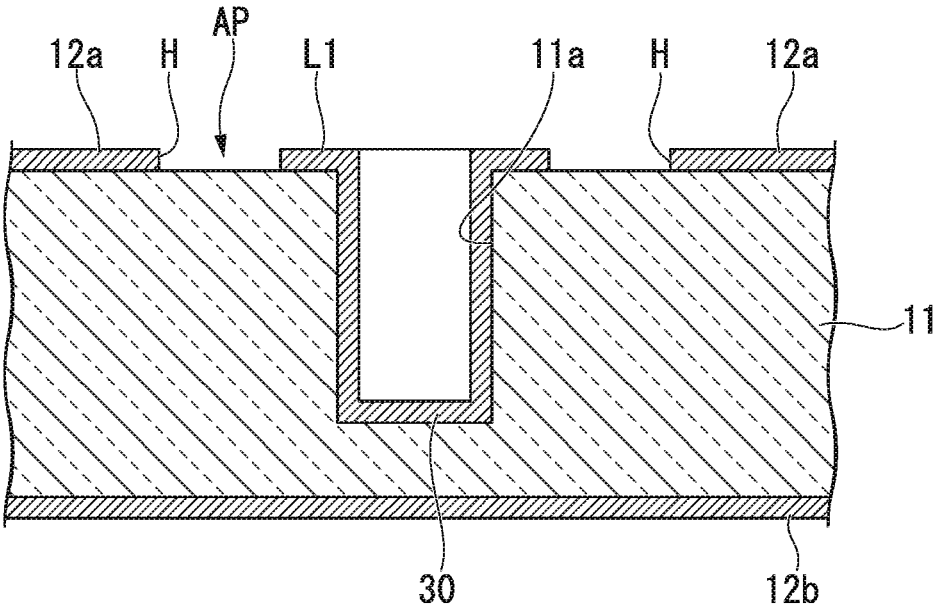
FIG. 6 is a cross-sectional view showing a configuration example of a blind via according to the first embodiment of the present invention.
Figure 7:
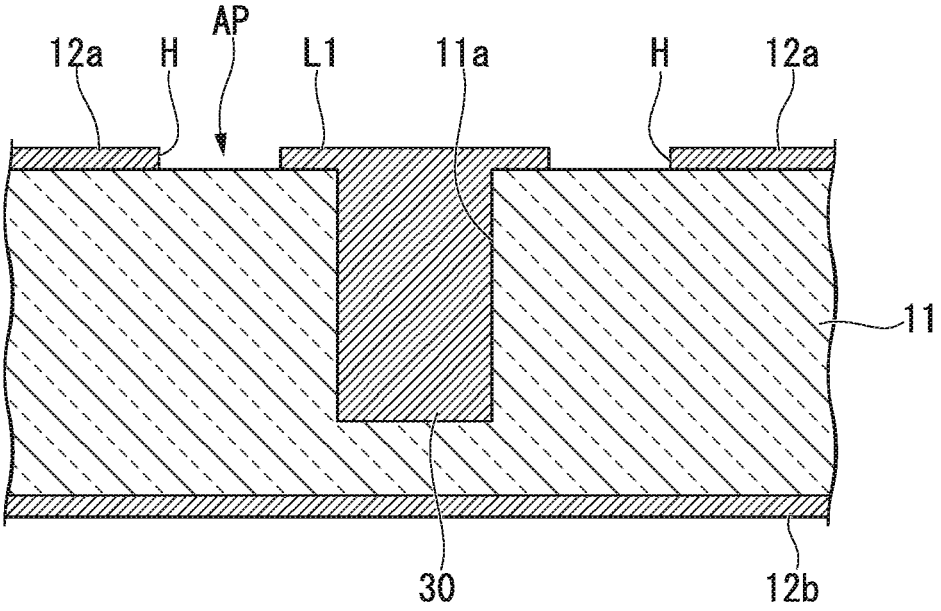
FIG. 7 is a cross-sectional view showing a configuration example of a blind via according to an embodiment of the present invention.

FIGS. 6 and 7 are cross-sectional views showing a configuration example of the blind via in the first embodiment of the present invention. As shown in FIG. 6, the blind via 30 is formed along the inner wall of the hole 11*a* formed, for example, from the opening H side to the middle of the thickness direction of the dielectric substrate 11, and is a member having a cylindrical shape having a closed longitudinal end.

Alternatively, as shown in FIG. 7, the blind via 30 is a columnar member formed so as to fill in the hole 11*a* formed from the opening, H side to the middle of the thickness direction of the dielectric substrate 11, for example.

The blind via 30 is formed together with the land L1 in either of the configurations of FIGS. 6 and 7. In addition, the blind via 30 is formed after forming an underlayer (underlayer formed of titanium, tungsten or the like) on the inner wall of the hole 11*a*. In FIGS. 6 and 7, illustration of the underlayer is omitted. The shape of the blind via 30 may be a shape other than a cylindrical shape having a closed longitudinal end (or a columnar shape) (for example, a quadrangular prism shape or a rectangular tube shape).

As shown in FIG. 5, the pole member 40 is a rectangular parallelepiped member including a conductor post (post member) 41 and a support member 42. The pole member 40 is disposed in a tube of a waveguide 20 such that the conductor post 41 is coaxial with the blind via 30. The conductor post 41 is formed of a metal such as copper, aluminum or the like, an alloy thereof, or the like. The conductor post 41 is a member having a cylindrical shape or a columnar shape whose diameter is the same diameter (or approximately the same diameter) as the blind via 30 and is connected to the blind via 30 by the conductive connecting member 50. Likewise the blind via 30, the length of the conductor post 41 is strictly set to a predetermined length. The shape of the conductor post 41 may be a shape other than a cylindrical shape or a columnar shape (for example, a quadrangular prism shape or a rectangular tube shape).

As shown in FIG. 5, a land (second land) L2 having a larger diameter than the conductor post 41 is formed at one end (one end (lower end) disposed on the blind via 30 side) of the conductor post 41. At the bottom of the land L2, a conductive connecting member 50 used for connection with the blind via 30 is disposed. The land L2 has the same diameter (or approximately the same diameter) as the land L1 and is provided to increase the contact area with the conductive connecting member 50 and to increase the connection strength with the blind via 30.

The support member 42 is a rectangular parallelepiped member made of glass, resin, or the like, and supports the conductor post 41, and in order to facilitate mounting of the conductor post 41 (mounting on the post wall waveguide 10). The above-described conductor post 41 is embedded in the support member 42, for example, so as to pass through the center (center of gravity) of the support member 42. The entirety of the conductor post 41 is embedded in the support member 42 except for the end portion where the land L2 is formed. That is, the support member 42 is provided so as to surround the conductor post 41 except for the end portion of the conductor post 41 where the land L2 is formed. The length of the conductor post 41 is smaller than the length in the vertical direction of the support member 42. Therefore, the upper end of the conductor post 41 is positioned lower than the upper surface of the support member 42.

It is preferable that the length of the support member 42 in the width direction (Y direction) is shorter than the length in the longitudinal direction (axial direction of the waveguide 20). This is due to the following reasons. The high-frequency signal propagating in the tube of the waveguide 20 propagates in the longitudinal direction (axial direction of the waveguide 20) while being reflected by the pair of right and left narrow walls 21*c*, 21*d* of the waveguide 20. When the high-frequency signal propagates inside the supporting member 42, the wavelength becomes shorter than when propagating through the inside of the waveguide 20. Therefore, if the length of the support member 42 in the width direction is long, an unnecessary phase rotation may occur and adverse effects may occur. In order to minimize such unnecessary phase rotation, it is desirable that the length of the support member 42 in the width direction is shorter than the length in the longitudinal direction.

The conductive connecting member 50 is a member used for connecting the blind via 30 and the conductive post 41 of the pole member 40. Specifically, the conductive connection member 50 is used to electrically connect the blind via 30 and the conductor post 41 and fix the first end of the blind via 30 and the above-mentioned one end of the conductor post 41. As the conductive connecting member 50, for example, a conductive adhesive such as solder or silver paste, a spherical member having a solder layer formed on its surface (for example, a spherical member made of copper), or the like can be used.

Here, in the case of the blind via 30 having the configuration shown in FIG. 6, when using, for example, solder as the conductive connecting member 50, solder melted by heating flows into the inside of the blind via 30, possibly causing a connection failure. Therefore, in the case of the blind via 30 having the structure shown in FIG. 6, it is preferable to use the spherical member having a diameter larger than the inner diameter of the blind via 30. With such a connecting member, the spherical member is soldered to one end of the blind via 30 by the solder formed on the surface of the spherical member in a state where the spherical member is retained at the first end (upper end) of the blind via 30. Therefore, the above-described connection failure is prevented.

In the transmission line 1 having the above configuration, the high frequency signal guided from the −X side to the post-wall waveguide 10 passes through the waveguide region G surrounded by the first conductor layer 12*a* and the second conductor layer 12*b* of the post-wall waveguide 10 and the post-wall 13 (a pair of the first post-walls 13*a* and 13*b*) in the direction from the −X side to the +X side. When the high frequency signal propagating in the waveguide region G of the post-wall waveguide 10 reaches the formation position of the blind via 30, the high frequency signal is guided to the tube of the waveguide tube 20 via the blind via 30 and the pole member 40 connected by the conductive connection member 50. The high frequency signal guided to the pole member 40 is radiated into the tube of the waveguide tube 20 from the conductor post pillar 41 arranged in a state protruding from the post-wall waveguide 10 in the tube of the waveguide tube 20, and propagates in the waveguide tube 20 in the direction from the −X side to the +X side.

As described above, in the present embodiment, the waveguide tube 20 and the post-wall waveguide 10 connected such that through the opening H formed in the first conductor layer 12*a* of the post-wall waveguide 10, the inside of the tube of the waveguide tube 20 and the waveguide region G of the post-wall waveguide 10 communicate with each other. A blind via 30 having a first end disposed inside the opening H is formed in the dielectric substrate 11 of the post wall waveguide 10, In the tube of the wave guide 20, a pole member 40 is disposed that includes a conductor post 41 and a support member 42 and is formed such that the conductor post 41 is coaxial with the blind via 30.

Here, the blind, via 30 formed in the dielectric substrate 11 is considered to have a function of once releasing the waveguide mode of the high-frequency signal propagating in the waveguide region G of the post-wall waveguide 10 and then guiding it to the outside of the post-wall waveguide 10 (inside the tube of the waveguide tube 20). In addition, the conductor post pillar 41 arranged in a protruding state in the tube of the waveguide 20 is considered to have a function of a starting point of forming a waveguide mode in the waveguide 20 of the high-frequency signal guided to the outside of the post wall waveguide 10 by the blind via 30. With these functions, in the present embodiment, it is considered that reflection loss can be lowered over a wide band.

In the present embodiment, the first conductor layer 12*a* of the post-wall waveguide 10 and the waveguide tube 20 are connected such that the axial direction of the waveguide tube 20 and the extending direction of the waveguide region G of the post-wall waveguide 10 are the same direction. For this reason, if the post-wall waveguide 10 and the bottom portion of the waveguide tube 20 (the respective bottom portions located on the −Z side) are supported by a support portion (not shown), for example, compared to the conventional configuration (configuration in which the waveguide tube is vertically attached to the dielectric substrate forming the post-wall waveguide), it is possible to firmly hold the waveguide tube 20 and the post-wall waveguide 10

Although the first embodiments of the present invention have been described above, the present invention is not limited to the above-described embodiments, and can be freely changed within the scope of the present invention. For example, the following first to fourth modified examples can be considered.

First Modified Example

Figure 8:
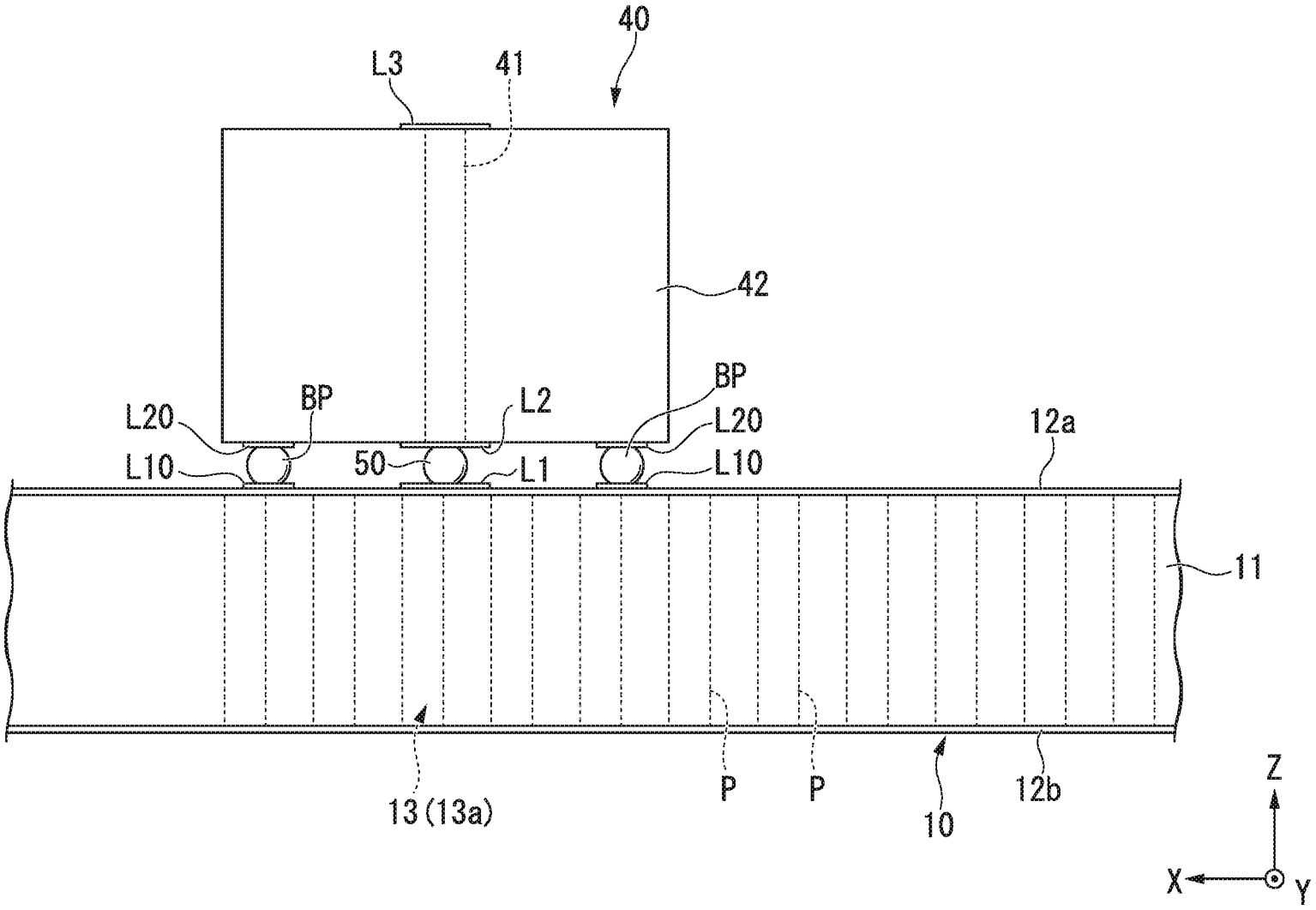
FIG. 8 is a cross-sectional view showing a first modified example of the transmission line according to an embodiment of the present invention.

FIG. 8 is a cross-sectional view showing a first modified example of a transmission line according to the first embodiment of the present invention. In FIG. 8, the same members as those shown in FIG. 5 are denoted by the same reference numerals and description may be omitted. In the above-described embodiment, the pole member 40 is configured to be supported only on the post-wall waveguide 10 by the conductive connecting member 50. However, as shown in FIG. 8, the pole member 40 may be supported at a plurality of positions on the post wall waveguide 10.

As shown in FIG. 8, in the present modified example, the lands L20 are formed at the four corners of the bottom portion of the support member 42 which forms a portion of the pole member 40. The land L20 is formed, for example, by plating metal such as copper on the bottom portion, and is a member having a circular shape in plan view, for example. The shape of the land L20 in plan view may be a shape other than a circular shape (for example, a quadrangular shape).

Four lands L10 are formed on the post wall waveguide 10. These lands L10 are formed at positions facing each of the lands L20 in the vertical direction in a state in which the pole member 40 is disposed on the post wall waveguide 10 so that the conductor post 41 is coaxial with the blind via 30. The land L10 is formed of the same material as the land L20, for example, and is a member having the same shape as the land L20. The land L10 may be formed of a material different from that of the land L20 or may have a shape different from that of the land L20.

Bumps BP are provided between the opposing lands L10 and L20, respectively. The bump BP is a spherical member that supports the bottom portion of the pole member 40 on the post wall waveguide 10. As the bump BP, for example, a spherical solder (so-called solder ball) or a spherical member having a solder layer formed on the surface thereof as with the conductive connecting member 50 can be used. The shape of the bump BP may be a shape other than a spherical shape.

In the pole member 40 shown in FIG. 8, the conductor post 41 is formed so as to extend from the bottom surface to the upper surface of the support member 42, and a land L3 having a larger diameter than the conductor post 41 is formed on the upper surface of the support member 42. The land L3 is thrilled of the same material as the land L2 formed on the bottom surface of the support member 42 and is a member having the same shape as the land L2. The land L3 may be formed of a material different from that of the land L2, or may have a shape different from that of the land L2. Furthermore, the land L3 may be omitted.

As described above, in the present modification, on the post wall waveguide 10, the pole member 40 is supported by the conductive connecting member 50 and the plurality of bumps BP. Therefore, the pole member 40 can be stably and firmly supported on the post-wall waveguide 10 as compared with the above-described embodiment.

Second Modified Example

Figure 9:
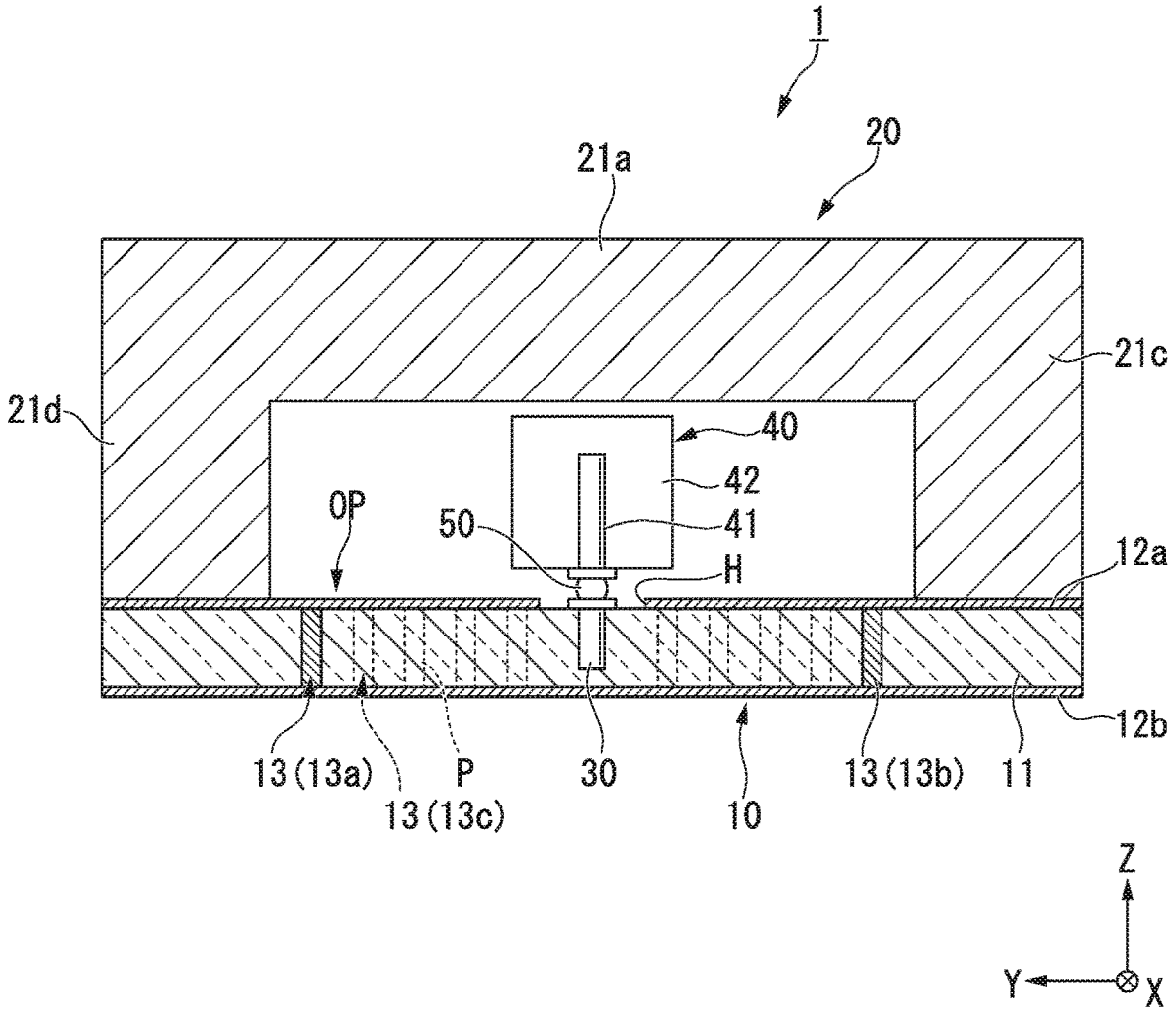
FIG. 9 is a cross-sectional view showing a second modified example of the transmission line according to the first embodiment of the present invention.

FIG. 9 is a cross-sectional view showing a second modified example of a transmission line according to an embodiment of the present invention. FIG. 9 is a cross-sectional view of the second modified example corresponding to a cross-sectional view taken along a line B-B in FIG. 1. In the embodiment described above, the width of the waveguide tube 20 is set wider than the width of the post-wall waveguide 10. On the other hand, in the present modified example, as shown in FIG. 9, the width of the waveguide tube 20 and the width of the post-wall waveguide 10 may be the same (or substantially the same). Comparing FIG. 9 to FIG. 3, in the present modified example, the thickness of the left and right pair of narrow walls 21*c* and 21*d* of the waveguide tube 20 is reduced and the width of the waveguide tube 20 and the width of the post-wall waveguide 10 are made the same. It is also possible to set the width of the waveguide tube 20 to be narrower than the width of the post-wall waveguide 10 unless the high-frequency signal propagating in the tube of the waveguide tube 20 leaks to the outside.

Third Modified Example

In the transmission line 1 described in the above-described embodiment, the direction in which the waveguide region G of the post-wall waveguide 10 extends and the axial direction of the waveguide tube 20 are the same. However, the direction in which the waveguide region G of the post-wall waveguide 10 extends and the axial direction of the waveguide tube 20 may intersect (for example, orthogonal) in plan view. That is, when the post-wall waveguide 10 and the bottom portion (bottom portions located on the −Z side) of the waveguide tube 20 are supported by a support portion (not shown), even if the direction in which the waveguide region G of the post-wall waveguide 10 extends and the axial direction of the waveguide tube 20 intersects in plan view, the waveguide tube 20 and the post-wall waveguide 10 can be firmly held as compared with the conventional configuration as in the above-described embodiment (embodiment that the direction in which the waveguide region G of the post-wall waveguide 10 extends and the axial direction of the waveguide tube 20 are the same).

Fourth Modification Example

In the above-described embodiment, the case where the support member 42 constituting a portion of the pole member 40 disposed in the tube of the waveguide 20 has a rectangular parallelepiped shape has been described as an example. However, the support member 42 is not limited to a rectangular parallelepiped shape; however, may be another shape (for example, a spherical shape or a columnar shape).

Hereinafter, the transmission line 1 according to the second embodiment of the present invention will be described with reference to the drawings. In the following description, the same reference numerals as in the first embodiment are assigned to constituent elements having the same configuration as in the first embodiment, and a detailed description thereof will be omitted. In the present embodiment, the configuration of the post wall of the post wall waveguide is different from that of the first embodiment.

Figure 10:
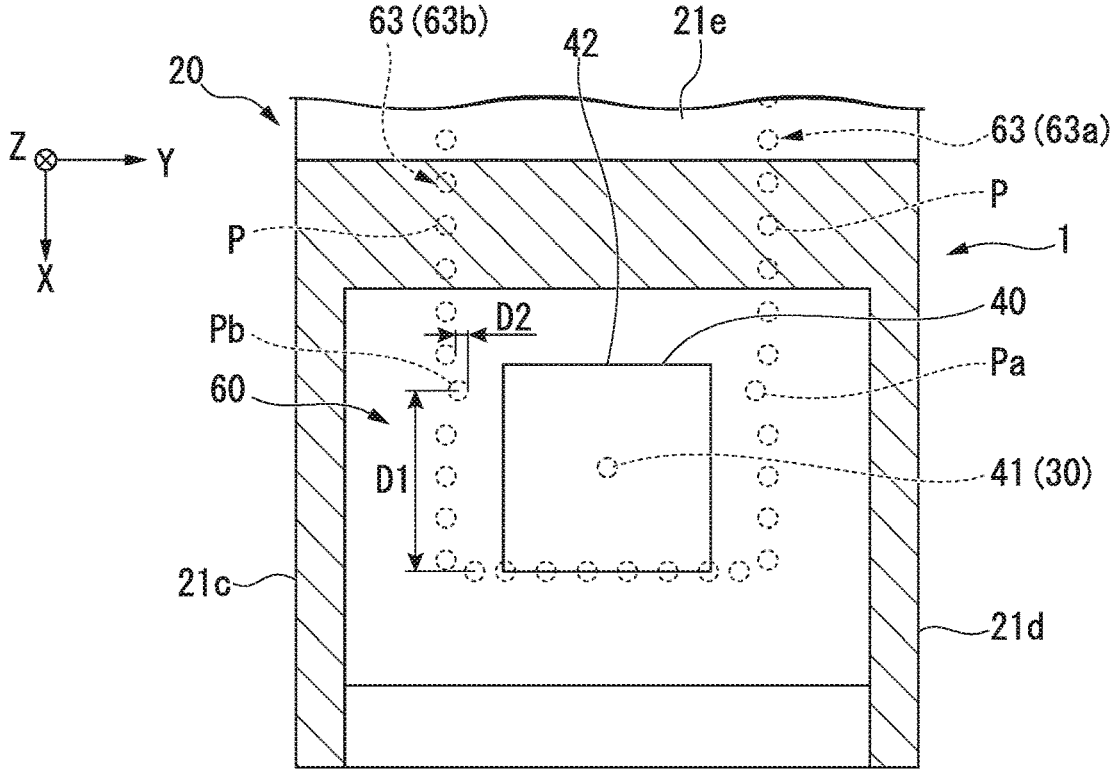
FIG. 10 is a cross-sectional view of the second embodiment corresponding the cross-sectional view taken along a line C-C in FIG. 2.

FIG. 10 is a cross-sectional view of a second embodiment corresponding to the sectional view taken along the line C-C in FIG. 2. As shown in FIG. 10, the transmission line 1 according to the present embodiment includes a post wall waveguide 60, a waveguide 20, a blind via 30, and a pole member 40, and transmits a high-frequency signal along the longitudinal direction (X direction) of the transmission line 1. In this embodiment, for the sake of easy understanding, the transmission line 1 will be described as an example of transmitting a high-frequency signal in the direction from the −X side to the +X side. However, it is also possible to transmit a high-frequency signal in the direction from the +X side to the −X side.

In addition, the high-frequency signal transmitted through the transmission line 1 is, for example, a high-frequency signal in the E band (70 to 90 GHz-band).

The post-wall waveguide 60 according to the present embodiment includes a dielectric substrate 11, a first conductor layer 12*a*, and a second conductor layer 12*b* which have the same configurations as those of the dielectric substrate 11, the first conductor layer 12*a*, and the second conductor layer 12*b* of the first embodiment as shown by FIG. 2. The post-wall waveguide 60 further includes a post wall 63, and is a waveguide having a waveguide region G surrounded by the first conductor layer 12*a*, the second conductor layer 12*b*, and a post wall 63 (a pair of first post walls 63*a* and 63*b*, and a second post wall 63*c* to be described later).

The post wall 63 is a wall member formed by arranging a plurality of conductor posts P so as to penetrate the dielectric substrate 11 and connect between the first conductor layer 12*a* and the second conductor layer 12*b*. Here, the conductor post P is formed by metal plating of copper or the like in a hole portion (through-hole) penetrating the dielectric substrate 11 in the thickness direction (direction along the Z axis), for example. The post-wall waveguide 60 can also be fabricated by processing a double-sided copper-clad laminate such as a printed circuit board (PCB).

The post wall 63 includes a pair of first post walls 63*a* and 63*b* extending parallel to the longitudinal direction (X direction) of the post wall waveguide 60 and a second post wall 63*c* extending in the width direction (Y direction) of the post wall waveguide 10. The pair of first post walls 63*a* and 63*b* are formed by arranging a plurality of conductor posts P in two rows along the longitudinal direction at a predetermined interval in the width direction. The second post wall 63*c* is formed by arranging a plurality of conductor posts P in one row between the +X side end portions of the pair of first post walls 63*a* and 63*b*.

In the present embodiment, the pair of first post walls 63*a* and 63*b* includes post protrusions Pa and Pb protruding toward the waveguide region G (FIG. 2) (the inner side of the waveguide region G), respectively. That is, the post protrusions Pa and Pb protrude from the first post walls 63*a* and 63*b* so as to approach each other. Each post wall 63*a* and 63*b* has a plurality of conductor posts P arranged at intervals similarly to the first embodiment. In the present embodiment, the post protrusions Pa and Pb are formed by a portion of the conductor posts P of the plurality of conductor posts P displaced toward the waveguide region G (FIG. 22 (the inside of the waveguide region G). The post protrusions Pa and Pb of the pair of post walls 63*a* and 63*b* are disposed at equivalent positions in a direction (predetermined direction, X direction) in which the waveguide region G extends. Here, the distance D1 in the predetermined direction from the end (the end close to the second post wall 63*c*) to the post protrusion Pa and Pb in the predetermined direction (X direction) of the waveguide region G (FIG. 2) is shorter than the distance D1 on the basis of the intra-tube wavelength of the high-frequency signal to be transmitted. In the present embodiment, the distance D1 is 29 to 45% of the in-tube wavelength of the high-frequency signal.

For example, when the intra-tube wavelength of the transmission line 1 at the E band center frequency of 78.5 GHz is 2604 μm, the distance D1 is set within the range of 769 to 1169 μm. By setting the distance D1 within the above range, the width of a part of the waveguide is locally narrowed, so that the impedance matching is improved and the reflection loss can be reduced over a wide band.

The distance D2 at which the post protrusions Pa and Pb protrude toward the waveguide region C1 (FIG. 2) may be appropriately determined as long as the high-frequency signal propagating in the waveguide region is within the range of no leakage to the outside of the postwall waveguide 60 may be set.

As shown in FIG. 10, in the present embodiment, the post protrusions Pa and Pb are formed by a part of the conductor posts P of the plurality of conductor posts P displaced toward the waveguide region G. However, the configuration of the post protrusions Pa and Pb is not limited to the above.

Figure 11:
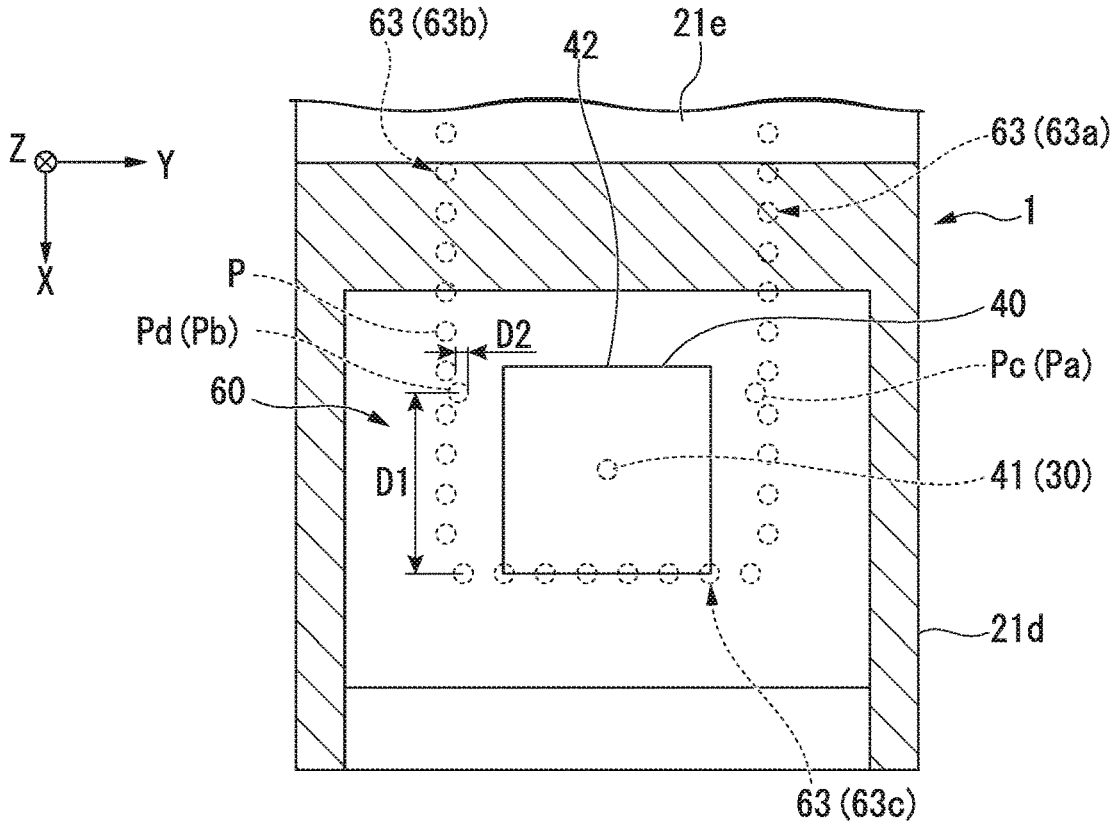
FIG. 11 is a cross-sectional view of a modified example of the second embodiment corresponding to the cross-sectional view taken along a line C-C in FIG. 2.

FIG. 11 is a cross-sectional view of a modification of the second embodiment corresponding to the sectional view taken along the line C-C in FIG. 2. As shown in FIG. 11, the post protrusions Pa and Pb may be formed by other conductor posts Pc and Pd adjacent to the plurality of conductor posts P arranged at intervals. In FIG. 11, the other conductor posts Pc and Pd are arranged between two adjacent conductor posts P in the X direction and at positions closer to the waveguide region G. The other conductor posts Pc and Pd may be disposed at the same position in the X direction with respect to one conductor post P and at a position close to the waveguide region G.

Further, in the present embodiment, in each of the post walls 63*a* and 63*b*, one conductor post P out of the plurality of conductor posts P is displaced toward the waveguide region G; however, the post protrusions Pa and Pb may be formed by a plurality of conductor posts P, respectively, which is displaced toward the waveguide region G In the modified example of the present embodiment, one post conductor Pc (or Pd) adjacent to the plurality of conductor posts P is provided in each of the post walls 63*a* and 63*b*; however, by a plurality of other conductor posts Pc (or Pd), the post protrusions Pa and Pb may be formed, respectively.

Although the embodiments of the present invention have been described above, the present invention is not limited to the above-described embodiments, and can be freely changed within the scope of the present invention. In addition, the first to fourth modifications of the first embodiment described above can also be applied to the second embodiment.

Example 1

The inventor of the present application actually designed and simulated the transmission line having the above-described first embodiment, and determined the intensity distribution of the high-frequency signal transmitted by the transmission line, and the reflection characteristic and the transmission characteristic of the transmission line. The design parameters of the simulated transmission line 1 are as follows.

(Post-Wall Waveguide 10)

Thickness of dielectric substrate 11: 520 [μm]

Relative permittivity of dielectric substrate 11: 3.82

Distance between first post-walls 13*a* and 13*b* (distance between each center): 1540 [μm]

Distance between second post-wall 13*c* and the blind via 30 (distance between each center): 480 [μm]

Diameter of opening H (anti-pad AP): 340 [μm]

(Waveguide Tube 20)

Height inside tube: 1149 [μm]

Width inside tube: 2500 [μm]

Distance from center of conductor post 41 to narrow wall 21*e*: 985 [μm]

(Blind Via 30)

Diameter: 100 [μm]

Length: 420 [μm]

Diameter of land L1: 200 [μm]

(Pole Member 40)

Length in longitudinal direction: 1000 [μm]

Width: 970 [μm]

Height: 700 [μm]

Diameter of conductor post 41: 100 [μm]

Diameter of land L2: 200 [μm]

(Conductive Connection Member 50)

Height: 100 [μm]

Figure 12:
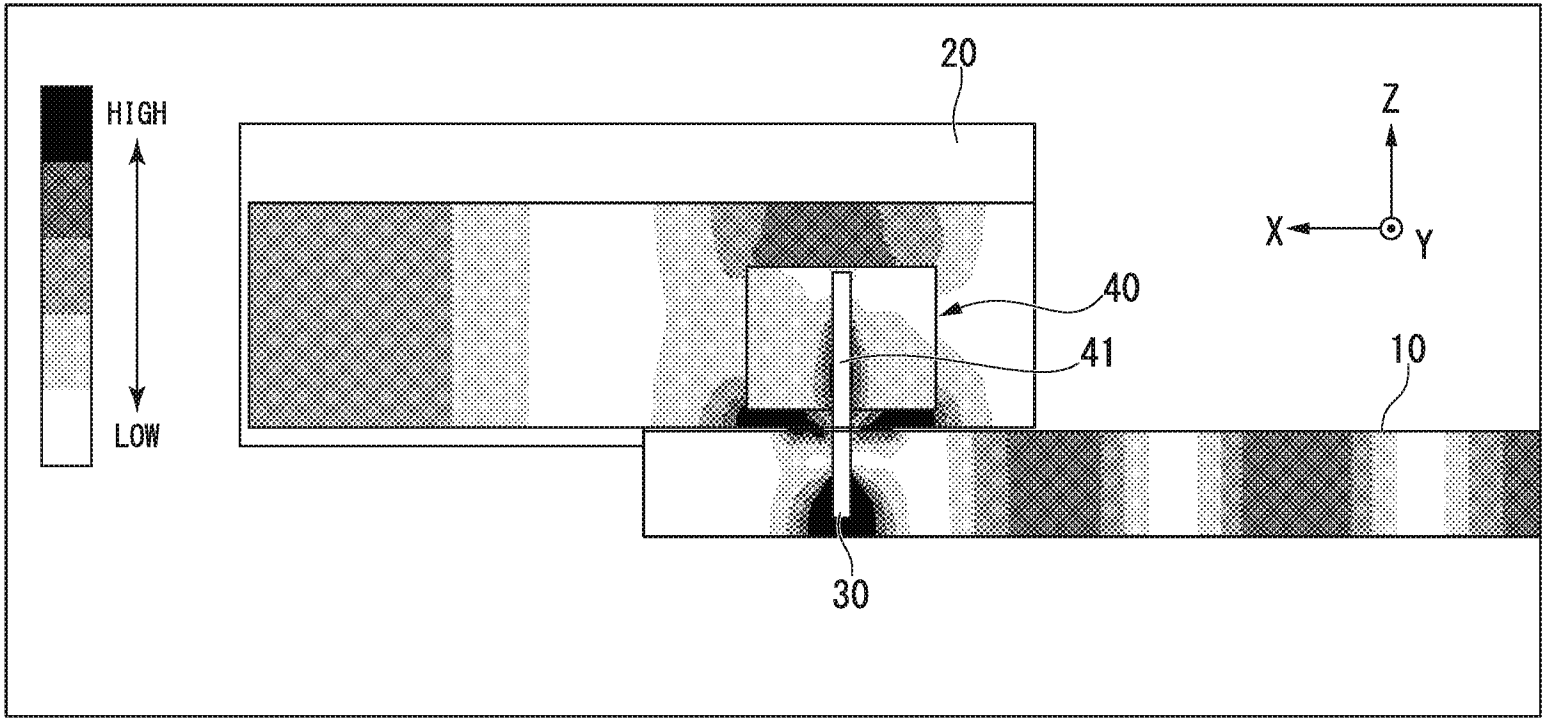
FIG. 12 is a diagram showing a simulation result of an electric field intensity distribution of a high-frequency signal transmitted by a transmission line according to the first example (Example 1) of the present application.

FIG. 12 is a diagram showing a simulation result of the electric field intensity distribution of the high frequency signal transmitted by the transmission line according to the examples. In FIG. 12, darker portion indicates higher intensity of the electric field. The simulation result shown in FIG. 12 shows a case where a high-frequency signal of a certain frequency (for example, 80 [GHz]) is guided from the right side (−X side) on a drawing sheet to the post-wall waveguide 10 and transmitted in the left direction (+X direction) on a drawing sheet. The high-frequency signal guided to the post-wall waveguide 10 is guided to the waveguide tube 20 and then transmitted inside the tube of the waveguide tube 20 in the left direction (+X direction) on a drawing sheet.

Referring to FIG. 12, in the right side portion on a paper sheet of the post-wall waveguide 10, the electric field intensity of the high-frequency signal changed in a stripe pattern in the direction from the right side on the drawing sheet to the left side on the drawing sheet (transmission direction). As a result, it was found that the high-frequency signal guided to the post-wall waveguide 10 was transmitted in the transmission direction in a certain mode inside the post-wall waveguide 10. Likewise, the electric field intensity of the high-frequency signal changed in a stripe pattern in the transmission direction also in the left side portion on the drawing sheet of the waveguide tube 20. As a result, it was found that the high-frequency signal guided to the tube of the waveguide tube 20 was transmitted in the transmission direction in a certain mode inside the waveguide tube 20.

Referring to FIG. 12, at the position where the blind via 30 of the post-wall waveguide 10 is provided, the electric field intensity of the high-frequency signal does not change in a stripe pattern, and the electric field intensity of the high-frequency signal was significantly increased between the second end of the blind via 30 and the bottom surface (the second conductor layer 12*b*) of the post-wall waveguide 10. Such electric field intensity is considered to be obtained by temporarily releasing the mode of the high frequency signal, which propagates in the waveguide region G (FIG. 2) of the post-wall waveguide 10, by the blind via 30.

In addition, referring to FIG. 12, the electric field intensity of the high-frequency signal was also significantly increased between the second end of the pole member 40 and the post-wall waveguide 10. In particular, the electric charge intensity was significantly increased at an upper portion of a portion where the anti-pad AP having a circular ring shape is formed. By obtaining such electric field intensity, it is considered that formation of a mode starting from the conductor post 41 provided with the pole member 40 is performed.

Figure 13:
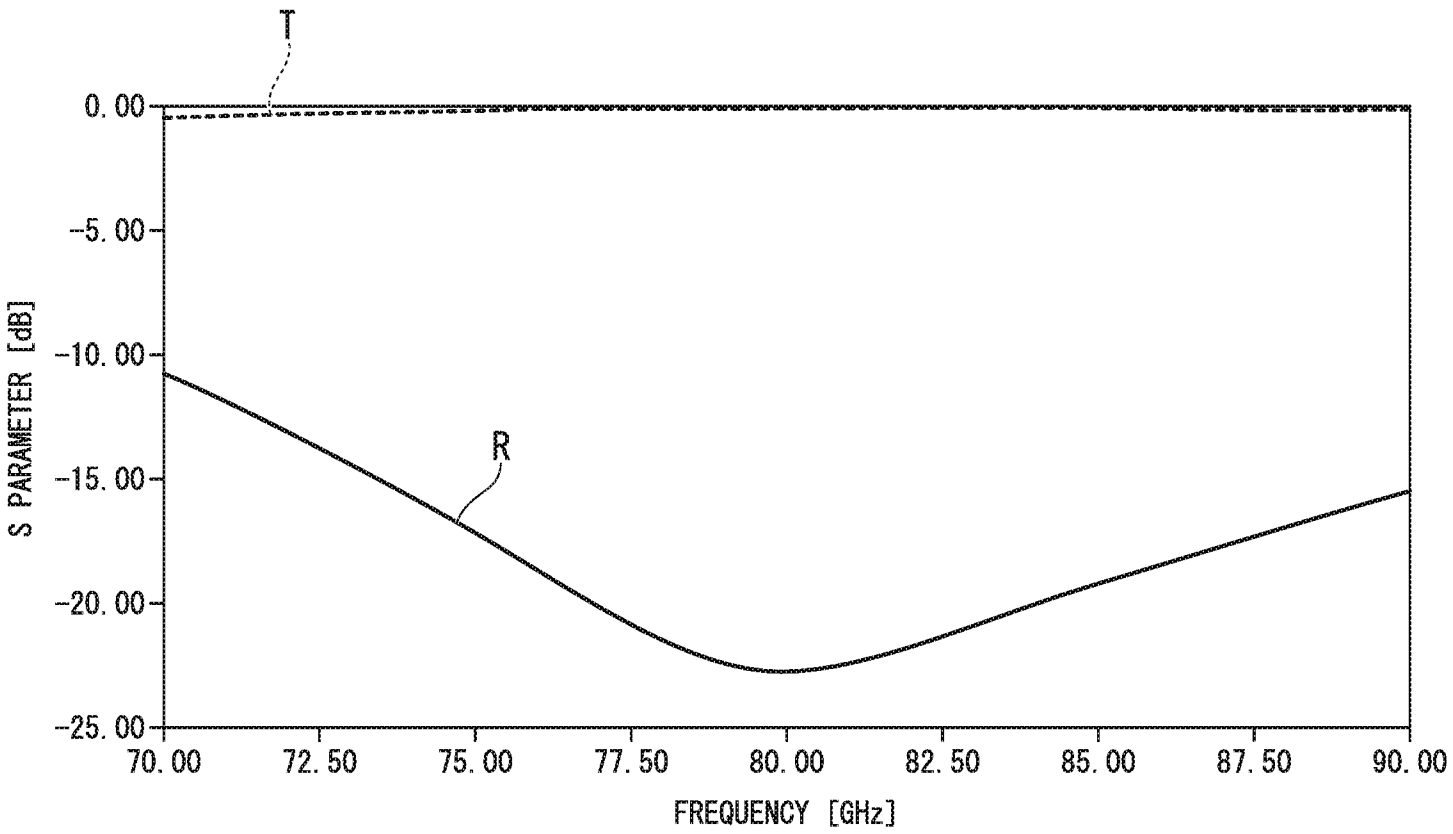
FIG. 13 is a diagram showing simulation results of reflection characteristics of a transmission line according to the Example 1.

FIG. 13 is a diagram showing simulation results of reflection characteristics and transmission characteristics of the transmission line (i.e., S Parameter in dB vs. Frequency in GHz) according to Example 1. In FIG. 13, the curve denoted by reference character R is a curve showing the reflection characteristic of the transmission line, and a curve denoted by T is a curve showing the transmission characteristic of the transmission line. Referring to the curve R in FIG. 13, the band where the S parameter is −15 [dB] or less (band with low reflection loss) was approximately 73 to 90 [GHz]. As described above, it is found that the transmission line according to the present example has a low reflection loss over a wide band, and it is possible to transmit a high-frequency signal of E band (70 to 90 GHz-band), for example, with low loss.

Example 2

Furthermore, the inventor of the present application actually designed and simulated the transmission line of the above-described second embodiment to obtain the reflection characteristic of the transmission line. The design parameters of the simulated transmission line 1 are as follows.

(Post-Wall Waveguide 60)

Thickness of dielectric substrate 11: 520 [μm]

Relative permittivity of dielectric substrate 11: 3.82

Distance between first post-walls 63*a* and 63*b* (distance between each center): 1540 [μm]

Distance between second post-wall 63*c* and the blind via 30 (distance between each center): 480 [μm]

Diameter of opening H (anti-pad AP): 340 [μm]

(Waveguide Tube 20)

Height inside tube: 1149 [μm]

Width inside tube: 2500 [μm]

Distance from center of conductor post 41 to narrow wall 21*e*: 985 [μm]

Diameter of conductor post P: 100 [μm]

Distance of adjacent conductor posts P (distance between centers): 200 [μm]

Wavelength in the tube of post-wall waveguide at the center frequency of the E band at 78.5 GHz: 2604 [μm]

Distance D1 in predetermined direction from end portion to post protruding portions Pa and Pb in the predetermined direction (X direction) of the waveguide region G: 870 [μm]

Distance D2 of post protruding portions Pa and Pb protruding toward inner side of the waveguide region G: 55 [μm]

(Blind Via 30)

Diameter: 100 [μm]

Length: 420 [μm]

Diameter of land L1: 200 [μm]

(Pole Member 40)

Length in longitudinal direction: 1000 [μm]

Width: 970 [μm]

Height: 700 [μm]

Diameter of conductor post 41: 100 [μm]

Diameter of land L2: 200 [μm]

(Conductive Connection Member 50)

Height: 100 [μm]

Figure 14:
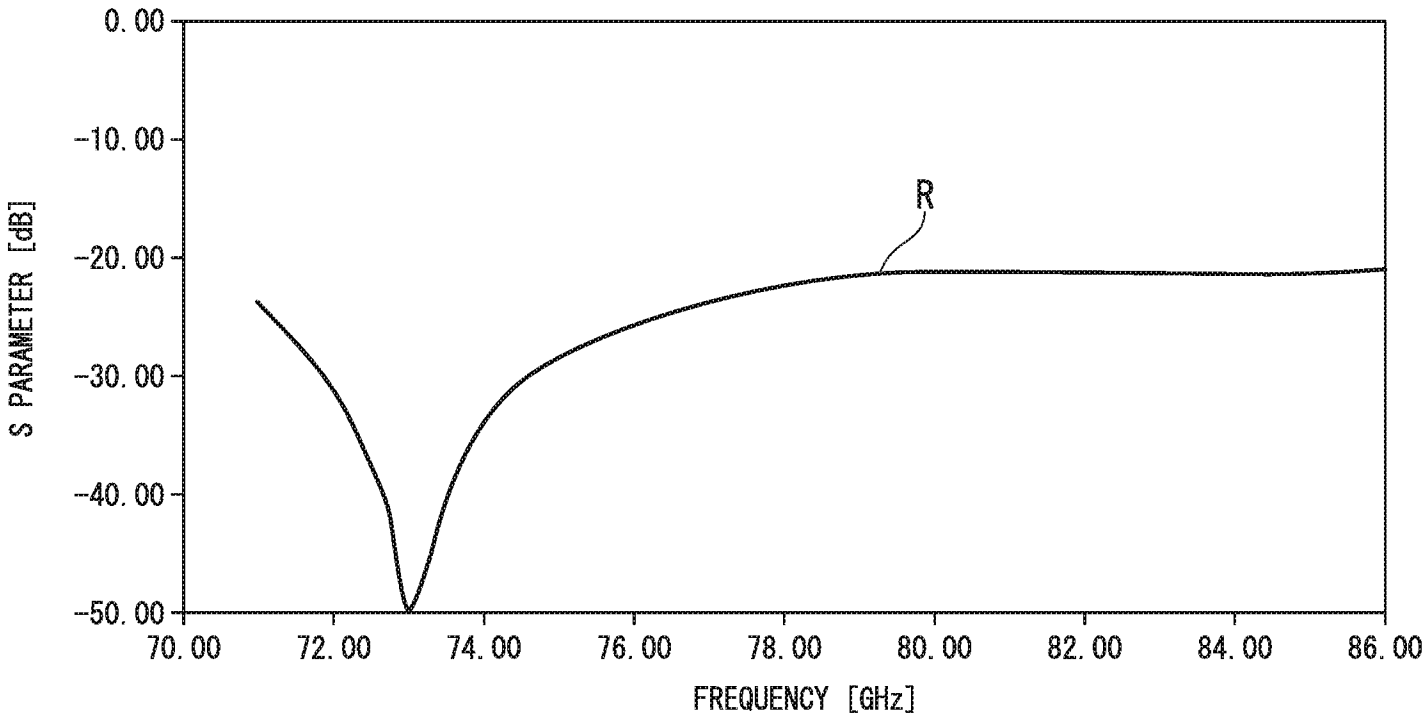
FIG. 14 is a graph showing simulation results of reflection characteristics of a transmission line according to the second example (Example 20) of the present application.

FIG. 14 is a graph showing the simulation result of the reflection characteristic of the transmission line (i.e., S Parameter in dB vs, Frequency in GHz) according to the second example. In FIG. 14, the curve denoted by reference symbol R is a curve showing the reflection characteristic of the transmission line. Referring to the curve R in FIG. 14, it can be confirmed that the S parameter is −20 dB or less in the band of at least 71 to 86 [GHz] and the reflection loss is low in the wide band. As described above, the transmission line according to the second embodiment has a low reflection loss over a wide band, and it is possible to transmit a high-frequency signal of the F hand (70 to 90 [GHz] band) with a low loss.

DESCRIPTION OF THE REFERENCE SYMBOLS

1: transmission line, 10, 60: post-wall waveguide, 11: dielectric substrate, 12*a*: first conductor layer, 12*b*: second conductor layer, 13*a*, 13*b*, 63*a*, 63*b*: first post-wall, 20: waveguide tube, 21*b*: wide wall, 30: blind via, 40: pole member, 41: conductor post, 42: supporting member, 50: conductive connection member, BP: bump, H: opening, L1, L2: land, OP: opening, G: waveguide region, Pa, Pb: post protrusion portion, P, Pc, Pd: conductor post

The invention claimed is:

1. A transmission line, comprising:

a post-wall waveguide which comprises a dielectric substrate on which a pair of post-walls is formed and a first conductor layer and a second conductor layer opposed to each other with the dielectric substrate interposed therebetween, and in which a region surrounded by the pair of post-walls, the first conductor layer, and the second conductor layer is a waveguide region, a waveguide tube having a hollow rectangular shape and having a bottom wall including an opening portion formed therein, the waveguide tube being connected with the first conductor layer so as to cover the opening portion by the first conductor layer, and in which an inside of the waveguide tube communicates with the waveguide region through an opening formed in the first conductor layer, a blind via formed in the dielectric substrate such that one end is disposed inside the opening, and a guide member comprising a post member connected to the one end of the blind via and a support member supporting the post member, the guide member being disposed in the waveguide tube such that the post member is coaxial with the blind via, wherein the support member has a rectangular parallelepiped shape in which a length in a direction perpendicular to an axial direction of the waveguide tube is shorter than a length in the axial direction of the waveguide tube.

2. A transmission line, comprising:

a post-wall waveguide which comprises a dielectric substrate on which a pair of post-walls is formed and a first conductor layer and a second conductor layer opposed to each other with the dielectric substrate interposed therebetween, and in which a region surrounded by the pair of post-walls, the first conductor layer, and the second conductor layer is a waveguide region, a waveguide tube having a hollow rectangular shape and having a bottom wall including an opening portion formed therein, the waveguide tube being connected with the first conductor layer so as to cover the opening portion by the first conductor layer, and in which an inside of the waveguide tube communicates with the waveguide region through an opening formed in the first conductor layer, a blind via formed in the dielectric substrate such that one end is disposed inside the opening, and a guide member comprising a post member connected to the one end of the blind via and a support member supporting the post member, the guide member being disposed in the waveguide tube such that the post member is coaxial with the blind via;

wherein the blind via and the post member are connected by a conductive connection member.

3. The transmission line according to claim 2, wherein:

at the one end of the blind via, a first land having a larger diameter than the blind via and on which the conductive connecting member is disposed is formed; and at one end disposed on the blind via side of the post member, a second land having a larger diameter than the post member and on which the conductive connecting member is disposed is formed.

4. The transmission line according to claim 2, wherein the conductive connecting member is a spherical member having a solder layer formed on a surface of the spherical member.

5. The transmission line according to claim 2, wherein the blind via is formed along an inner wall of a hole formed from the one end to a portion of the dielectric substrate and has a cylindrical shape having a closed longitudinal end.

6. The transmission line according to claim 2, comprising a plurality of bumps supporting the support member at a plurality of positions on the first conductor layer.

7. The transmission line according to claim 2, wherein the support member has a rectangular parallelepiped shape in which a length in a direction perpendicular to an axial direction of the waveguide tube is shorter than a length in the axial direction of the waveguide tube.

8. The transmission line according to claim 2, wherein an axial direction of the waveguide tube is in the same direction as a signal propagation direction of the waveguide region of the post-wall waveguide.

9. The transmission line according to claim 2, wherein the pair of post walls each includes a post protrusion portion protruding toward the waveguide region.

10. The transmission line according to claim 9, wherein each of the post walls comprises a plurality of conductor posts arranged at intervals, and the post protrusions are formed by a portion of conductor posts of the plurality of conductor posts displaced toward the waveguide region.

11. The transmission line according to claim 9, wherein each of the post walls comprises a plurality of conductor posts arranged at intervals, and the post protrusions are formed by other conductor posts disposed adjacent to the plurality of conductor posts at intervals different from the intervals of the plurality of conductor posts.

12. The transmission line according to claim 9, wherein the waveguide region is formed to extend in a predetermined direction, and the post protrusion portions on the pair of post walls are arranged at equivalent positions in the predetermined direction.

13. The transmission line according to claim 12, wherein a distance from an end of the waveguide region in the predetermined direction to the post protrusion portion is set based on a wavelength of a signal transmitted through the transmission line.

14. A transmission line, comprising:

a post-wall waveguide which comprises a dielectric substrate on which a pair of post-walls is formed and a first conductor layer and a second conductor layer opposed to each other with the dielectric substrate interposed therebetween, and in which a region surrounded by the pair of post-walls, the first conductor layer, and the second conductor layer is a waveguide region, a waveguide tube having a hollow rectangular shape and having a bottom wall including an opening portion formed therein, the waveguide tube being connected with the first conductor layer so as to cover the opening portion by the first conductor layer, and in which an inside of the waveguide tube communicates with the waveguide region through an opening formed in the first conductor layer, a blind via formed in the dielectric substrate such that one end is disposed inside the opening, a guide member comprising a post member connected to the one end of the blind via and a support member supporting the post member, the guide member being disposed in the waveguide tube such that the post member is coaxial with the blind via, and a plurality of bumps supporting the support member at a plurality of positions on the first conductor layer.

* * * * *